United States Patent [19]

Bakule et al.

[11] 4,119,600

[45] Oct. 10, 1978

[54] MIGRATION-RESISTANT BINDER COMPOSITIONS FOR BONDING NONWOVEN FIBERS; ALSO METHODS AND ARTICLES

[75] Inventors: Ronald D. Bakule, Jenkintown; Robert A. Gill, Abington; Lawrence K. Wempe, Landsale, all of Pa.

[73] Assignee: Rohm and Haas Company, Philadelphia, Pa.

[21] Appl. No.: 686,980

[22] Filed: May 17, 1976

[51] Int. Cl.[2] ..... C08L 33/00

[52] U.S. Cl. ..... 260/29.6 RW; 260/29.6 N; 260/29.6 HN; 260/29.7 W; 428/428; 428/452; 428/454; 428/512; 428/513; 428/514; 428/533; 428/537

[58] Field of Search ..... 260/29.6 RW, 29.6 N, 260/29.6 HN, 29.7 W; 428/452, 454, 428, 533, 537, 512, 513, 514

[56] References Cited

U.S. PATENT DOCUMENTS

| | | | |
|---|---|---|---|
| 2,790,735 | 4/1957 | McLaughlin et al. | 428/452 |
| 2,790,736 | 4/1957 | McLaughlin et al. | 428/452 |
| 2,874,066 | 2/1959 | McLaughlin et al. | 428/452 |
| 3,048,501 | 8/1962 | Miller et al. | 428/452 |
| 3,177,172 | 4/1965 | Adams | 260/29.6 WB |
| 3,205,187 | 9/1965 | Vanderhoff | 260/29.6 RW |
| 3,266,971 | 8/1966 | Hartley | 260/29.6 RW |
| 3,405,114 | 10/1968 | Nasrmann et al. | 526/117 |
| 3,583,881 | 6/1971 | Kennedy | 428/452 |
| 3,671,472 | 6/1972 | McNamee et al. | 428/452 |
| 3,719,629 | 3/1973 | Martin et al. | 260/33.2 EP |
| 3,799,902 | 3/1974 | Anderson | 260/29.6 R |
| 3,849,183 | 11/1974 | Chick et al. | 428/452 |
| 3,936,542 | 2/1976 | Cox | 427/288 |

*Primary Examiner*—M. J. Welsh

*Attorney, Agent, or Firm*—Harold L. Greenwald

[57] ABSTRACT

Migration-resistant binder compositions for bonding nonwoven fibers are disclosed. These compositions comprise (A) an anionically-stabilized polymer latex; (B) a water-soluble polymer of 20–100% by weight of mer units containing an amine group and having a viscosity average molecular weight between 5,000 and 300,000; and (C) a volatile base. Usually, the compositions have a solids content between 10% and 60% by weight, a viscosity below 3,000 centipoise, a pH above 5, and a component (B) content between 0.1% and 20% by weight of the solids. In alternative compositions, component (B) is replaced by component (B'), a water-insoluble polymer with the same amine group content and a viscosity average molecular weight between 5,000 and 100,000.

24 Claims, No Drawings

MIGRATION-RESISTANT BINDER COMPOSITIONS FOR BONDING NONWOVEN FIBERS; ALSO METHODS AND ARTICLES

BACKGROUND OF THE INVENTION

This invention relates to migration-resistant binder compositions for bonding nonwoven fibers to form composites such as fabrics, bonded papers, paperboards, etc., the methods for applying these binder compositions and the nonwoven fibrous composites produced thereby. The bonded nonwoven fibrous composites may have a regular or a random array of fibers consisting of natural fibers, synthetic fibers, or mixtures of these. The bonded nonwoven fibrous composites are useful in the production of articles of various shapes, such as flat sheets or three-dimensional objects, and of various densities, such as low density insulating materials among others. Migration-resistant binders are particularly advantageous in the manufacture of nonwoven fabrics and saturated papers.

Binder migration in nonwoven composites is the phenomenon whereby binders that have been evenly distributed throughout the body of a nonwoven by a wet application, e.g., saturation, move to the outer face of the fabric during drying. Generally, this causes an increase in the fabric hand and a lack of strength in the direction normal to the plane of the sheet which, in extreme cases, can cause delamination of the treated web into two separate pieces. The alternative of increasing the amount of binder to achieve a specified strength would increase the cost of the product.

Binder migration is a consequence of the movement of liquid to the surface brought about by temperature differences between the surface and the interior of the webs. It is favored (1) by thick webs, (2) low binder/-water ratios, (3) sudden, rapid heat increase, and (4) very stable latex binders. Efforts to control migration through the binder itself (i.e., as opposed to external changes in heating conditions, etc.) have generally centered on inhibiting binder movement after the binder is applied to the web through the use of (1) thickeners, e.g., alginates, or (2) coagulation agents which may be multivalent salts, e.g., aluminum sulfate, or cationic surfactants as noted below. The use of thickeners has several disadvantages, a principal one being that it limits processing speeds. The disadvantage of coagulating agents which work by decreasing the thermal stability of the latex is that the system must still be triggered by a temperature rise which then simultaneously favors binder migration, and the lowered degree of thermal stability increases the problems in handling the binder composition during plant processes such as pumping and mixing. In contrast, amine polymers of the instant invention do not decrease the thermal stability of the latex polymer with which they are used. Indeed, in the ordinary situation, the binder compositions are stable to 100° C. Thus, because of both high shear stability and high thermal stability, our binder composition does not give trouble by breaking or flocculating if a pump through which it is passing, in a plant operation, warms it or if small amounts splash onto moving parts of the equipment, such as bearings.

In U.S. Pat. Nos. 2,912,349 and 2,912,350, Videen and others disclose impregnation of porous bodies with a heat-coagulable aqueous latex and, by applying heat, the coagulation of the latex solids within the pores of the body prior to volatilizing the residual water and thereby the prevention of migration of latex particles during drying. The two patents offer data to show that the coagulation temperature of the latex can be controlled by the addition of surfactants of ionic charge opposite to that of the latex, thus, that an anionic latex can have its heat coagulation temperature decreased by the addition of a cationic surfactant. The cationic surfactants recited include quaternary ammonium compounds and amines. In U.S. Pat. No. 2,982,682, Matlin and Kine teach a migration-resistant binder comprising a water-insoluble copolymer, having a molecular weight from 100,000 to ten million, and containing some amine groups and a water soluble aminoplast crosslinking agent for use in bonding nonwoven fibrous materials. In U.S. Pat. No. 3,300,429, Glavis et al. disclose a coating system which comprises a water-insoluble copolymer dispersion, a water-soluble ammonium salt of a low molecular weight acid copolymer, and a dispersing agent which is an anionic or a nonionic surfactant. At least one of the polymer components contains at least a quarter of a percent of polymerized units containing a ureido group one type of which includes those with amine functionality.

The migration of latex in saturated substrates during the drying process is frequently troublesome. Potentially, the distribution of latex in a masking tape or interlining non-woven substrate, for example, will be highly non-uniform if (1) a badly migrating latex is used, (2) no modifications are made in the manufacture of the saturated substrate, and (3) no external antimigration agents are used. Effects on the saturated paper or fabric properties can be postulated; one which is well-documented is the loss of delamination resistance which occurs when the latex distribution is such that a disproportionally low latex level is found in the center of the sheet. Such an effect can be compensated for by the use of a higher latex level or by changing one or more of the three factors enumerated above.

Such changes are not without other consequences, however. Some of these considerations are: (1) The selection of a non-migrating latex within the short list of those otherwise optimum in cost-performance benefits to the customer is usually not possible. Only a limited number of latices are significantly non-migrating and their cost-performance range is limited. (2) Modifications of machine running conditions, particularly the temperature of the first few drying cans or the use of an infrared heater bank in order to immobilize a thermally unstable polymer latex before the more efficient higher temperature drying sections are reached, are known to be effective to an extent. Further, any such adjustment would tend to require slowing the machine down if the production rate is drying capacity limited. (3) External anti-migration agents are available. An anionic latex can usually be immobilized at a lower temperature by the addition of a cationic water-soluble polymer. The resultant system frequently lacks sufficient shear stability to be used; in this case, non-ionic surfactant is post-added, apparently improving the mechanical stability without grossly affecting the thermal stability of the latex. Such systems are not only expensive, but require formulation by the converter. Further, the chemicals used frequently exhibit adverse effects on the color and heat-aged properties of the saturated sheets.

BRIEF SUMMARY OF THE INVENTION

In accordance with the present invention, certain amine-containing polymers have been found which produce migration-resistant binder compositions when mixed with an inexpensive anionically stabilized polymer latex and a volatile base. During the first stages of the drying as the volatile base evaporates from the saturated paper or fabric, the emulsion is flocculated in situ without the need for thermal triggering and, after drying, a nonwoven fabric or saturated paper is obtained with a uniform binder distribution. Without limiting the invention to this or any other theoretical construct, it is convenient for the purpose of teaching this invention to consider it as a series of reaction steps as follows:

(1) The binder composition at the initial high pH consists of (A) latex polymer stabilized by negative charges from adsorbed surfactant or dispersant ions or indigenous to the molecules in the polymer particles, (B) an amine-containing polymer at a high enough pH to be essentially uncharged, and (C) a volatile base such as ammonia in sufficient concentration to make the pH high enough so that the amine polymer is uncharged.

(2) Early in the drying process, the volatile base evaporates and the pH of the biner drops rapidly as a consequence. With the drop in pH, the higher hydrogen-ion concentration results in protonation of the amine-containing polymer making it cationic.

(3) The cationic protonated-amine-containing polymer reacts, by a charge neutralization process sometimes known as liposalt formation, with the anionic surfactant or dispersant or with anionic sites on the latex polymer so as to decrease the charge on the latex particles.

(4) The latex particles flocculate or deposit onto the fiber, or do both, before appreciable migration of these particles can take place.

It should be appreciated that several of the steps can be occurring simultaneously and completion of the various steps is not necessary for the process to proceed essentially as described. For instance, the liposalt formation with surfactants may occur before appreciable protonation of the amine groups of the polymer takes place as the pH drops in Step 2. The binder composition need not be and indeed ordinarily is not unstable when heated even to the boil. The flocculation step can occur at any temperature as long as the ammonia or other volatile base evaporates, thus drying temperature is not critical to the migration resistance of this system.

The migration resistant binder composition for bonding non-woven fibers, comprises, in a preferred embodiment:

(A) an anionically stabilized polymer latex;

(B) a water-soluble polymer of 20% to 100% by weight of mer units containing an amine group and having a viscosity average molecular weight between 5,000 and 300,000; and (C) a volatile base.

In another embodiment, water-soluble component (B) is replaced by (B'), a water-insoluble polymer described as:

(B') a water-insoluble polymer of 20% to 100% by weight of mer units containing an amine group and having a viscosity average molecular weight between 5,000 and 100,000.

DETAILED DESCRIPTION OF THE INVENTION

This invention is concerned with the use, as the primary binder or as the predominant part thereof, of a negatively-charged latex of a water-insoluble polymer referred to as an anionically stabilized polymer latex. The preparation of such latexes is well known to those skilled in the art and is given in texts on the subject such as "Emulsion Polymerization: Theory and Practice" by D. C. Blackley published by Wiley in 1975 and "Emulsion Polymerization" by F. A. Bovey et al. published by Interscience Publishers in 1965. Particular water-insoluble polymers of interest are those of vinyl acetate with or without other monomers, such as ethylene and other olefins, vinyl chloride, vinylidene chloride, etc., styrene-butadiene copolymers (SBR), acrylonitrile-butadiene-styrene (ABS) copolymers, chloroprene copolymers, and acrylic and methacrylic ester polymers and copolymers. The acrylic and methacrylic ester polymers and copolymers are preferred and are preferably prepared by processes given in "Emulsion Polymerization of Acrylic Monomers: May, 1966" published by the Rohm and Haas Company, Philadelphia, Pa., incorporated herein by reference. (Additional suitable anionic dispersing agents include the higher fatty alcohol sulfates, such as sodium lauryl sulfate, alkylaryl sulfonates, e.g. sodium or potassium isopropylbenzene sulfonates or isopropyl naphthalene sulfonates, alkali metal higher alkyl sulfosuccinates, e.g. sodium octyl sulfosuccinate, sodium N-methyl-N-palmitoyltaurate, sodium oleyl isethionate, alkali metal salts of alkylarylpolyethoxyethanol sulfates or sulfonates, e.g. sodium t-octylphenoxypolyethoxyethyl sulfate having 1 to 5 oxyethylene units.) In general, the latex polymer is a polymer or copolymer of a monomer selected from the group styrene, butadiene, vinyl acetate, vinyl chloride, vinylidene chloride, acrylonitrile, chloroprene, esters of acrylic acid and esters of methacrylic acid..

The negative charge on the dispersed latex particles is obtained in any of several ways, the most common being the use of anionic surfactants or dispersants as the stabilizer during the emulsion polymerization or added to the emulsion after polymerization. Nonionic surfactants may, of course, also be present in the latex during or after polymerization of these anionically stabilized latexes. Another type of negatively-charged latex is that which is obtained as a result of including in the polymers small amounts of acidic groups, which may be in the salt form, such as an alkali metal or ammonium salt. Examples of such acidic groups are those derived from maleic acid, vinyl sulfonic acid, crotonic acid, acrylic acid, methacrylic acid, itaconic acid, and the like. Among the useful surfactants and dispersants are the salts of fatty rosin and napthenic acids, condensation products of napthalene sulfonic acid and formaldehyde of low molecular weight, carboxylic polymers and copolymers of the appropriate hydrophile-lipophile balance, higher alkyl sulfates, such as sodium lauryl sulfate, alkyl aryl sulfonates, such as dodecyl benzene sulfonate, sulfosuccinates, such as sodium dioctyl sulfosuccinate, alkylarylpolyethoxyethanol sulfates and sulfonates, such as ammonium t-octylphenoxypropylethoxyethyl sulfate having 1 to 5 oxyethylene units, and the various other anionic surfactants and dispersants well-known in the art.

The migration-resistant binder compositions of this invention contain, in addition to the major component noted above, a polymer containing from 20% to 100%, and preferably at least 40%, by weight of the amine-containing monomer including the following categories:

1. Aminoalkyl vinyl ethers or sulfides wherein the alkyl groups may be straight-chain or branchedchain type and have from two to three carbon atoms and wherein in nitrogen atom may be a primary, secondary, or tertiary nitrogen atom (U.S. Pat. No. 2,879,178). In the latter instance, one of the remaining hydrogen atoms may be substituted by alkyl, hydroxyalkyl, or alkoxyalkyl groups, the alkyl components of which may have one to four carbon atoms, preferably one carbon atom only. Specific examples include:

β-aminoethyl vinyl ether
β-aminoethyl vinyl sulfide
N-monomethyl-β-aminoethyl vinyl ether or sulfide
N-monoethyl-β-aminoethyl vinyl ether or sulfide
N-monobutyl-β-aminoethyl vinyl ether or sulfide
N-monomethyl-3-aminopropyl vinyl ether or sulfide 2. Acrylamide or acrylic esters, such as those of the formula II:

$$H_2C{=}C(R)\overset{O}{\overset{\|}{C}}{-}(X)_n{-}A{-}NR^*R^\circ \qquad \text{(II)}$$

wherein

R is H or $CH_3$;

$n$ is 0 or 1;

X is O or N(H);

A, when $n$ is zero, is $O(CH_2)_x$- wherein $x$ is 2 to 3, or (O-alkylene)$_y$ wherein (O-alkylene)$_y$ is a poly(oxyalkylene) group, having a molecular weight in the range from 88 to 348, in which the individual alkylene radicals are the same or different and are either ethylene or propylene; and A, when $n$ is 1, is an alkylene group having two to 4 carbon atoms;

R* is H, methyl, or ethyl; and

R° is H, phenyl, benzyl, methylbenzyl, cyclohexyl, or ($C_1$–$C_6$) alkyl.

Examples of compounds of formula II include:

dimethylaminoethylacrylate or methacrylate
β-aminoethyl acrylate or methacrylate
N-β-aminoethyl acrylamide or methacrylamide
N-(monomethylaminoethyl)-acrylamide or methacrylamide
N-(mono-n-butyl)-4-aminobutyl acrylate or methacrylate methacryloxyethoxyethylamine acryloxypropoxypropoxypropylamine 3. N-acryloxyalkyl-oxazolidines and N-acryloxyalkyltetrahydro-1,3-oxazines and the corresponding compounds in which the "alkyl" linkage is replaced by alkoxyalkyl and poly(alkoxy-alkyl), all of which are embraced by Formula III:

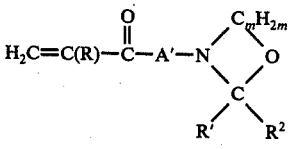

(III)

wherein

R is H or $CH_3$; $m$ is an integer having a value of 2 to 3;

R′, when not directly joined to $R^2$, is selected from the group consisting of hydrogen, phenyl, benzyl, and ($C_1$–$C_{12}$) alkyl groups;

$R^2$, when not directly joined to R′, is selected from the group consisting of hydrogen and ($C_1$–$C_4$) alkyl groups;

R′ and $R^2$, when directly joined together, form a 5- to 6-carbon ring with the attached carbon atom of the ring in the formula, i.e., R′ and $R^2$, when joined together, are selected from the group consisting of pentamethylene and tetramethylene; and A′ is $O(C_mH_{2m})$- or (O-alkylene)$_n$ in which (O-alkylene)$_n$ is a poly(oxyalkylene) group, having a molecular weight in the range from 88 to 348, in which the individual alkylene radicals are the same or different and are either ethylene or propylene.

The compounds of Formula III can hydrolyze under various conditions to secondary amines. The hydrolysis produces products having the Formula IV:

$$H_2C{=}C(R){-}\overset{O}{\overset{\|}{C}}{-}A'N(H){-}(C_mH_{2m}){-}OH \qquad \text{(IV)}$$

The compounds of Formula III are disclosed in U.S. Pat. No. 3,037,006 and U.S. Pat. No. 3,502,627 in the hands of a common assignee, and their corresponding foreign applications and patents and any of the monomeric compounds disclosed therein may be used in making the copolymers to be used in the fiber binding composition of the present invention.

Examples of compounds of Formula III include:

oxazolidinylethyl methacrylate
oxazolidinylethyl acrylate
3-(gamma-methacryloxypropyl)-tetrahydro-1,3-oxazine
3-(β-methacryloxyethyl)-2,2-pentamethylene-oxazolidine
3-(β-methacryloxyethyl-2-methyl-2-propyloxazolidine
N-2-(2-acryloxyethoxy)ethyl-oxazolidine
N-2-(2-methacryloxyethoxy)ethyl-oxazolidine
N-2-(2-methacryloxyethoxy)ethyl-5-methyl-oxazolidine
N-2-(2-acryloxyethoxy)ethyl-5-methyl-oxazolidine
3-[2-(2-methacryloxyethoxy)ethyl)]-2,2-pentamethyleneoxazolidine
3-[2-(2-methacryloxyethoxy)ethyl)]-2,2-dimethyloxazolidine
3-[2-(methacryloxyethoxy)ethyl]-2-phenyl-oxazolidine.

Polymers of monomers which readily generate amines by hydrolysis are useful as the amine-containing component or to generate the amine-containing component polymer of this binder composition. Examples of such monomers are acryloxy-ketimines and -aldimines, such as those of Formulas V and VI following:

$$H_2C{=}(CR){-}COOA''N{=}Q \qquad \text{(V)}$$

$$H_2C{=}C(R){-}CO{-}(D)_{n''-1}{-}(B)_{n'-1}{-}(A^\circ)_{n^\circ-1}{-}N{=}Q \qquad \text{(VI)}$$

wherein R is H or $CH_3$;

Q is selected from the group consisting of

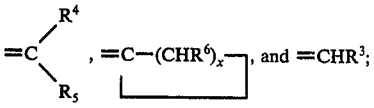

$R^6$ is H or it may be methyl in one $CHR^6$ unit;

$R^5$ is selected from the group consisting of ($C_1$–$C_{12}$)-alkyl and cyclohexyl groups;

$R^4$ is selected from the group consisting of ($C_1$–$C_{12}$)-alkyl and cyclohexyl groups;

$R^3$ is selected from the group consisting of phenyl, halophenyl, ($C_1$–$C_{12}$)-alkyl, cyclohexyl, and ($C_1$–$C_4$) alkoxyphenyl groups;

A″ is a ($C_2$–$C_{12}$) alkylene group;

A°, B and D are the same or different oxyalkylene groups having the formula —OCH($R^7$)-CH($R^7$)- wherein $R^7$ is H, $CH_3$, or $C_2H_5$;

$x$ is an integer having a value of 4 to 5;

$n°$ is an integer having a value of 1 to 200;

$n'$ is an integer having a value of 1 to 200; and $n''$ is an integer having a value of 1 to 200, the sum of $n°-1$, $n'-1$ and $n''-1$ having a value of 2 to 200.

Illustrative compounds of formulas V and VI are:

2-[4-(2,6-dimethylheptylidene)-amino]-ethyl methacrylate

3-[2-(4-methylpentylidine)-amino]-propyl methacrylate

β-(benzylideneamino)-ethyl methacrylate

3-[2-(4-methylpentylidene)-amino]-ethyl methacrylate

2-[4-(2,6-dimethylheptylidene)-amino]-ethyl acrylate 12-(cyclopentylidene-amino)-dodecyl methacrylate N-(1,3-dimethylbutylidene)-2-(2-methacryloxyethoxy)ethylamine N-(benzylidene)-methacryloxyethoxyethylamine N-(1,3-dimethylbutylidene)-2-(2-acryloxyethoxy)-ethylamine N-(benzylidene)-2-(2-acryloxyethoxy)ethylamine The compounds of Formulas V and VI hydrolyze in acid, neutral, or alkaline aqueous media to produce the corresponding primary amines or salts thereof in which the group -N = Q of the formulas becomes -$NH_2$ and O = Q. The compounds of Formulas V and VI are disclosed in U.S. Pat. No. 3,037,969 and U.S. Pat. No. 3,497,485, and any of the monomeric compounds therein disclosed may be used in the making of the copolymers to be used in the water-soluble polymer portion of the migration-resistant binder compositions of the present invention.

The preferred class of amine-containing polymers of this invention are water-soluble. By water-solubility is meant that the polymer is completely soluble either in free-base, neutral, or salt form. In other words, the solubility preferably exists at all pH's, especially in the range of about 4 to 10. A less preferred class of water-soluble amine-containing polymers are generally insoluble at high pH and soluble or partly soluble at acidic pH values, particularly in the pH range from about 4 to about 7. By partly soluble is meant both the situation in which some of the polymer is soluble in water as well as that in which the entire polymer dissolves in the form of micelles or aggregates individual molecules, generally, highly water swollen aggregates. The latter are often called colloidal solutions. It is preferred that most of the polymer be soluble at the acidic pH values. The water-soluble amine-containing polymers of this invention include both the completely soluble and the partly soluble polymers as described immediately above.

A useful but still less preferred class of amine-containing polymers are those which are water-insoluble and, as will be noted below, have a molecular weight corresponding to the lower end of the range for the water-soluble counterparts. These water-insoluble amine-containing polymers perform the same function as the water-soluble polymers. When these water-insoluble polymers are substituted for the water-soluble polymers in the various examples (*v.i.*), the migration resistance of the anionically stabilized polymer latex is improved; however, the improvement is usually not as great as that produced by the water-soluble polymers.

In general, the amine-containing polymers of 20 to 100% by weight of a monomer of categories 1., 2., 3., and 4., above may be obtained by solution polymerization in aqueous media, either neutral, alkaline, or acidic, depending upon the particular polymer sought. Generally, the polymerization is carried out in an aqueous medium containing a small amount of an acid, either organic or inorganic, such as acetic acid or hydrochloric acid. The amine-containing polymers include copolymers with up to 80% by weight one or more monoethylenically unsaturated monomers having appreciable water-solubility, such as methyl acrylate, acrylamide, methacrylamide, and quaternary ammonium salts derived from the amine monomers, such as 2-methacryloxyethyl trimethyl ammonium chloride. Small amounts of relatively insoluble comonomers may also be used to obtain the water-soluble polymers. The insoluble polymers may contain larger amounts of these comonomers. Such monomers include, as examples, acrylic acid esters with ($C_1$ to $C_{18}$) alcohols and methacrylic acid esters with alcohols having one to 18 carbon atoms, especially ($C_1$–$C_4$) alkanols; styrene, vinyltoluene, vinyl acetate, vinyl chloride, vinylidene chloride, substituted styrenes, butadiene, substituted butadienes, ethylene; and the nitriles and amides of acrylic or of methacrylic acid. The particular comonomer or comonomers used in making a given amine-containing polymer depends upon the proportion of amine-containing monomer used in making the copolymer. Preferably, a comonomer with relatively high solubility in water is exclusively used to make the water-soluble polymers. The polymers are thus polymers or copolymers of cationic and, optionally, nonionic vinyl monomers. Examples of the cationic monomers are the amines, imines and quaternary ammonium salts; the other recited monomers are nonionic. Thus, these water-soluble copolymers contain no acid groups other than trace amounts which may be present due to impurities in the monomers used or to small extent of hydrolysis during synthesis, storage or use.

The insoluble amine-containing polymers have a viscosity average molecular weight between 5,000 and 100,000 with the range 15,000 to 90,000 preferred. The molecular weight of the water-soluble polymers may fall within a wide range; typically, the viscosity average molecular weight lies between 5,000 and 300,000, with the range 40,000 to 100,000 being preferred. The amount of the amine-containing polymer may range from about 0.1% to about 20% by weight of the total weight of anionic latex polymer and amine-containing polymer, the range from 1% to 8% being preferred.

If desired, the negatively-charged latex may be supplemented with or mixed with up to about an equal weight, on a solid basis, of other binders, such as amylaceous materials (e.g., starch or the various materials mentioned in column 4, lines 28–35, of U.S. Pat. No. 3,671,742), proteinaceous materials, such as glue, gelatin, albumin, casein, and alpha protein, aminoplasts, such as urea/formaldehyde or melamine/formaldehyde resin-forming condensates, water-soluble or -dispersible linear polyester resins or cellulose ethers or esters, e.g., hydroxyethyl cellulose, carboxymethyl cellulose, and so on. This additional material is, of course, unnecessary to provide the properties desired although it may provide useful peripheral properties such as viscosity control or low cost. The negatively-charged latex A) is then at least 50% by weight of the binder solids and the water-soluble polymer B) is between 0.1% and 20% by weight of A) plus B).

The volatile base of preference is ammonia, which may be used as the sole volatile base or in admixture with other volatile or nonvolatile bases. Other volatile bases which may be employed are morpholine, the lower alkyl amines, 2-dimethylaminoethanol, N-methylmorpholine, ethylenediamine, and others. The amount of volatile base used is the quantity sufficient to bring the pH above 5 and preferably to the range of 7.0 to 8.5. The binder composition has a solids content in the range 10% to 60% by weight and a viscosity below 3,000 cps., a viscosity below 2,000 cps. being preferred.

The binders of this invention are utilized, for the most part, on three closely related substrates: 1) paper, 2) wet-laid nonwoven fabric, and 3) dry-laid nonwoven fabric. In general, the process of making a nonwoven composite comprises associating, within a web or mat, fibers selected from the group consisting of cellulosic fibers, polyamide fibers, glass fibers, vinyl resin fibers, and polyester fibers and bringing into contact with the fibers, the binder of this invention.

The dry-laid nonwoven fabric made by utilizing the binders of this invention can be composed of almost any fiber or blend of fibers, the choice being dependent on the end-use and economic factors. Preferably, the fabric is one in which the fibers are predominantly fibers selected from the group consisting of cellulosic fibers, polyamide fibers, glass fibers, vinyl resin fibers, and polyester fibers. Viscose rayon, acetate, cotton, wood, wool, polyester, polyamide, and acrylics are perhaps the most popular.

Viscose rayon offers the advantages of low cost and easy processing. Sanitary facings, hospital products, food and liquid filters, food wrap, sanitary napkins, wiping cloths, and interlinings are typical applications for viscose rayon webs. Acetate fibers are also low-priced and possess good dimensional stability, thermoplasticity, mildew resistance, and low moisture absorption.

Although wool fiber is expensive, it is used where bulk, warmth, and loft retention are needed. The primary end-use for cotton fibers in nonwoven applications is in cushioning and wadding.

Synthetic fibers such as polyester and polyamide are used alone and in blends with other man-made or natural fibers to obtain a more flexible nonwoven with better physical properties. From 25 to 50 percent polyester or polyamide fiber is often used in dry-laid nonwovens designed for interlinings, especially where durable-press properties are important. Applications requiring exceptional resistance to flexing and abrasion usually use a construction of 100 percent polyester or polyamide. One of the most important uses for polyester fibers is in fiberfill.

Acrylic fibers have high bulk, good recovery, and high resistance to moisture and chemicals. Other fibers used in nonwovens include glass fibers, used mainly for reinforcement; ceramic fibers; thermoplastic vinyl types which can be bonded with heat and pressure; and asbestos.

There are five basic steps in the preparation of a dry-laid nonwoven web: (1) opening and blending the fiber, (2) web formation, (3) binder formulation, (4) binder application, and (5) drying and curing. During opening, the fibers are separated and prepared for web formation. Blending, for special effects and more uniform structure, also occurs at this stage. The fibers are then oriented randomly, or in one, two, or three dimensions. Parallel-laid webs are made on cards or garnetts, which comb the fibers in the machine direction. Cross-laid webs are produced by plying two parallel-laid webs so that the fibers lie at angles to the machine direction. A stream of high-velocity air or an electrostatic field can be used to produce random-laid webs.

The latex-based binder can be used to bond dry-laid nonwovens, alone or in combination with mechanical methods such as needle-punching and spunbonding. The binder-to-fiber ratio will vary with the end-use of the nonwoven fabric. Saturation is probably the most widely used procedure for applying binders in the dry-laid manufacturing process. Thin, dense nonwoven webs are usually bonded by saturation. This process imparts excellent tensile strength properties as well as offering high production speeds. The nonwoven web can be saturated with latex by padding, roller coating, spreading, or flooded-nip methods.

When the web is saturated by padding, the nonwoven fabric, unsupported or supported by a blanket or screen, is dipped into a pad bath. To prevent pickoff, a lower roll of rubber, immersed in the pad bath with an upper roll of stainless steel is suggested. When complete immersion of the web in the bath is undesirable, a transfer roll can be used to apply the emulsion. Where more closely controlled resin pickup is desired, a doctor blade in contact with the transfer roll can be used to remove excess resin.

The fibers for most saturated papers and wet-laid nonwovens consist of wood pulp or a blend of wood pulp and synthetic fibers. Cotton fibers are also occasionally used. The synthetic fibers are added to impart softness, abrasion resistance, and tear strength to the web, and are up to 75 percent of its construction. The length and denier, as well as the type of synthetic fiber, will affect the properties of the nonwoven. Synthetic fibers longer than one-fourth inch often require special equipment and handling procedures.

Lightly beaten sulfate or sulfite pulps are usually used for the wood pulp portion of the furnish. Rayon and polyester are the most popular and economical synthetic fibers. Wet-cut, never-dried rayon fibers are preferred to dried fibers which can mat in the pulp furnish. Most hydrophobic fibers such as nylon, polyester, and acrylic are also often used. Of course, to obtain particular properties, less common fibers are often used, e.g., asbestos fibers to form backing sheets for vinyl floor covering.

In the preparation of the wood pulp slurry for wet-laid nonwovens, the sulfate or sulfite pulp is defibered in the pulper at a consistency of about 3 percent. This unbeaten pulp has a Canadian Standard Freeness (C.S.F.) of approximately 650. After defibering, the wood pulp is lightly beaten or refined to a C.S.F. of about 500.

Webs with very different properties can be produced from the same wood pulp simply by varying beating conditions; therefore, actual beating conditions will depend on the amount of wood pulp in the furnish as well as the properties desired in the final movement. The wood pulp for nonwovens which are to contain more than 50 percent wood fiber in the final web should be very lightly beaten to avoid production of a nonwoven with a stiff, papery hand. If the nonwoven is to contain more than 50 percent synthetic fiber, the wood pulp can be moderately beaten without an adverse effect on the hand. A typical pulp for a 50 percent rayon/50 percent wood fiber nonwoven might be beaten to a C.S.F. of 500, whereas the pulp for a 75 percent rayon/25 percent wood fiber nonwoven might have a C.S.F. of 400.

After the wood pulp is beaten and refined, it is transferred to a mixing chest where it is diluted to a consistency of 1 to 2 percent. Usually, the synthetic fibers are added to the mixing chest at this stage. After blending, the wood/synthetic fiber furnish goes to the consistency regulator, is further diluted, and finally is fed onto the wire at a 0.05 to 0.10 percent consistency in a continuous operation. After web formation, the nonwoven is saturated by an on-machine or off-machine process. If the web does not have enough integrity for saturation, a small amount of a wet-strength resin should be incorporated in the furnish, or the web can be supported between screens during saturation.

For the same furnish, the saturation process usually yields a stronger, stiffer web with less drape than would beater deposition. Saturation is a simpler process than beater deposition which requires very strict process control. Most webs bonded by saturation have a basis weight of 25 to 30 pounds per 3,000 square feet, while beater-deposited webs weigh over 12 pounds per 3,000 square feet.

Wet-laid nonwovens are usually dried on drying cans or in a tunnel drier, although any drying unit that removes moisture from the web is satisfactory.

In addition to migration resistance, the binders of the instant invention have a number of other advantages as compositions for binding nonwoven fibers. One such advantage is that the efficient flocculation produced by these binders results in very efficient utilization of the binder and little loss of the binder during the manufacture of the nonwoven fibrous product. This efficiency results in a direct cost saving for binder. Other advantages, both direct and indirect, accrue from the faster acceptable machine speeds in bonded paper and fabric production made possible by the binders of this invention.

To assist those skilled in the art to practice the present invention, the following modes of operation are suggested by way of illustration but are not intended to limit the invention disclosed herein. All parts and percentages are by weight and the temperature in degrees Celsius unless otherwise specifically noted.

In the test method used in the examples, unless otherwise stated, the binder compositions are diluted to 20% solids (or as noted), saturated into various base stocks and evaluated for migration resistance by the following method: Four pre-weighed sheets (2½ inches × 4½ inches) of base stock are saturated (20% bath solids or as noted) as a sandwich and dried (325° F.) on a hot plate under a weight (11 lbs.) for 15 minutes. After drying, the sandwich is separated into two groups of two sheets and re-weighed after conditioning overnight at 73° F. and 50% R.H. The resin migration from the top sheets to the bottom sheets (hot plate side) is calculated as the percent of the total resin pick-up of the four sheets.

Calculation:

$$\text{Percent Migration} = \frac{(\text{Resin Pick-Up in Bottom Sheets}) - (\text{Resin Pick-Up in Top Sheets}) \times 100}{\text{Total Resin Pick-Up}}$$

Base stocks used in the tests include:

(1) 100% Rayon wet-laid prebonded (Basis weight: 27.5 lbs./3 thousand square feet, 1.3 oz./yd.$^2$),
(2) Saturating paper (P-3 - grade, Basis weight: 37 lbs./3 thousand square feet) made from non-wet-strength bleached kraft, and
(3) Glass fabric (Style X4065), Owens Corning.

EXAMPLE A - HOMOPOLYMER

A 5-liter glass kettle equipped with stirrer, nitrogen inlet, thermometer, heating mantle, and feed pumps is charged with 1500 g. of deionized deoxygenated water. The charge is stirred and a nitrogen blanket is maintained on it. Then 7.0 g. of 0.15% aqueous $FeSO_4.7H_2O$ and 2.0 g. 1% aqueous tetra sodium(ethylene dinitrilo)-tetra acetate are added, the mixture is heated to 60° C., and simultaneous addition over a two-hour period is effected with:

Feed No. 1
500.0 g. 2-(3-oxazolidinyl)ethyl methacrylate (OXEMA)
500.0 g. deionized water
5.0 g. 70% aqueous tertiary-butyl hydroperoxide (TBHP)

Feed No. 2
5.0 g. sodium formaldehyde sulfoxylate.$2H_2O$ (SFS) diluted with water to 14.4 ml.

After completion of the feeds, the mixture is kept at 60° C. for 30 minutes, 0.4 g. 70% TBHP is added, 15 minutes later 0.15 g. SFS in 5.0 g. deionized water is added, being followed immediately by an addition of 0.25 g. of 70% TBHP. Fifteen minutes later, the mixture is cooled to room temperature, yielding a clear greenish-amber solution of total solids 17.9%, pH 8.3 and Brookfield viscosity (No. 1 spindle, 60 rpm) of 15 cps. This polymer has a viscosity average molecular weight of 115,000.

EXAMPLE B - COPOLYMER

A 5-liter glass kettle equipped with stirrer, nitrogen inlet, thermometer, heating mantle, and feed pumps is charged with 1500 g. of deionized deoxygenated water. The charge is stirred and a nitrogen blanket is maintained on it. Then 7.0 g. of 0.15% aqueous $FeSO_4.7H_2O$ and 2.0 g. 1% aqueous tetra sodium(ethylene dinitrilo)-tetra acetate are added, the mixture is heated to 60° C., and simultaneous addition over a two-hour period is effected with:

Feed No. 1
250.0 g. 2-(3-oxazolidinyl)ethyl methacrylate (OXEMA)
250.0 g. ethyl acrylate (EA)
500.0 g. deionized water
20.0 g. 70% aqueous tertiary-butyl hydroperoxide (TBHP)
35.7 g. tert-octylphenoxypolyethoxyethanol with 40 oxyethylene units Feed No. 2
20.0 g. sodium formaldehyde sulfoxylate.$2H_2O$ (SFS) diluted with water to 72 ml.

After completion of the feeds, the mixture is kept at 60° C. for 30 minutes, 0.4 g. 70% TBHP is added, 15 minutes later 0.15 g. SFS in 5.0 g. deionized water is added, being followed immediately by an addition of 0.25 g. of 70% TBHP. Fifteen minutes later, the mixture is cooled to room temperature, yielding a yellowish white dispersion of total solids 19.7%, pH 7.4 and Brookfield viscosity (No. 1 spindle, 60 rpm) of 6 cps. This polymer has a viscosity average molecular weight of 19,000. In acid solution at a pH in the 4 to 7 range, the copolymer does not dissolve completely, the initial emulsion becomes a slightly hazy system when the pH is lowered to about 5.5 by the addition of hydrochloric acid (5% aq.).

EXAMPLE C - HOMOPOLYMER

A 5-liter glass kettle equipped with stirrer, nitrogen inlet, thermometer, heating mantle, and feed pumps is charged with 1500 g. of deionized deoxygenated water. The charge is stirred and a nitrogen blanket is maintained on it. Then 7.0 g. of 0.15% aqueous $FeSO_4.7H_2O$ and 2.0 g. 1% aqueous tetra sodium(ethylene dinitrilo)-tetra acetate are added, the mixture is heated to 60° C., and simultaneous addition over a two-hour period is effected with:

Feed No. 1

500.0 g. dimethylaminoethyl methacrylate 500.0 g. deionized water 5.0 g. 70% aqueous tertiary-butyl hydroperoxide (TBHP)

Feed No. 2

5.0 g. sodium formaldehyde sulfoxylate.$2H_2O$ (SFS) diluted with water to 14.4 ml.

After completion of the feeds, the mixture is kept at 60° C., for 30 minutes, 0.4 g. 70% TBHP is added, 15 minutes later 0.15 g. SFS in 5.0 g. deionized water is added, being followed immediately by an addition of 0.25 g. of 70% TBHP. Fifteen minutes later, the mixture is cooled to room temperature, yielding a light-amber solution of total solids 15.4%, pH 8.9 and Brookfield viscosity (No. 1 spindle, 60 rpm) of 23 cps. This polymer has a viscosity average molecular weight of 63,700.

EXAMPLE 1

Effective Water-Soluble Polymer Level

The binder migration is determined on saturating paper base stock at a 20% dry add-on level. The anionically-stabilized polymer latex is made from 93.5% ethyl acrylate, 2.3% methylol acrylamide, 1.7% acrylamide, and 2.5% itaconic acid at 50.5% polymer solids and contains 1.0% of the anionic surfactant sodium lauryl sulfate based on polymer solids. To this is added varying amounts of the water-soluble polymer of Example A and sufficient ammonia to bring the pH to 7.5 and diluted to 20% on binder solids. The binder migration test results are:

| Example A Content: (on binder solids) | 0% | 1% | 3% | 3.5% | 5% |
|---|---|---|---|---|---|
| Percent Migration: | 69 | 55 | 39 | 36 | 13 |

It is clear from these data that a marked decrease in binder migration is observed at all levels of water-soluble polymer tested when compared with the binder used with none of the water-soluble polymer.

EXAMPLE 2

Molecular Weight of the Water-Soluble Polymer

Using the procedure of Example A, a copolymer - 95% OXEMA and 5% methyl methacrylate is made in a series of molecular weights by varying the initiator system as indicated in the table which follows. The table below also gives the molecular weight, the percent migration, and the viscosity of the binder composition at 20% solids for binders made from these water-soluble polymers and the anionically-stabilized polymer latex used in Example 1. The pH is adjusted to 8 with ammonia in each composition.

| | Water-Soluble Polymer (WSP) | | | Binder Composition[5] | |
|---|---|---|---|---|---|
| | Initiator[4] | | Molecular | % | |
| Ex. | TBHP | SFS | Weight[1] | Migration[2] | Viscosity[3] |
| 2a | — | — | No water-soluble polymer | 65 | 23 |
| 2b | 5.6 | 8.0 | ca. 10,000 | 57 | 12 |
| 2c | 5.6 | 8.0 | ca. 20,000 | 56 | 20 |
| 2d | 5.6 | 8.0 | 42,000 | 52 | 11 |
| 2e | 2.8 | 4.0 | 56,000 | 57 | 10 |
| 2f | 1.7 | 2.0 | 88,000 | 40 | 120 |
| 2g | 0.7 | 1.0 | 102,000 | 6 | 810 |
| 2h | 0.35 | 0.5 | 110,000 | 7 | 2000 |

[1]Viscosity average molecular weight.
[2]Determined using P-3 saturating paper procedure detailed above.
[3]Brookfield viscosity (25° C.; 60 RPM) on 20% solids blend, as used in migration test, after 14 days.
[4]Initiator system, percent based on monomer, used in the process of Example A to produce the water-soluble polymer. Examples 2b and 2c also had 17, and 3.2%, respectively, of mercaptoethanol added with the TBHP.
[5]WSP is 3% of total binder solids.

It is seen that the migration resistance is improved by the addition of the water-soluble polymer and that, in general, the improvement increases with molecular weight of the water-soluble polymer. Also, in general, the viscosity of the binder composition increases with the molecular weight of the water-soluble polymer.

EXAMPLE 3

Other Water-Soluble Polymer Compositions

The following table illustrates the utility of other water-soluble polymer examples polymerized by the procedure of Example A with initiator modifications to obtain the appropriate molecular weight as illustrated in Example 2. In all cases, significant improvement over the migration performance of the binder without water-soluble polymer is clearly seen.

| | Water-Soluble Polymer | | | | Binder Composition[1] | | |
|---|---|---|---|---|---|---|---|
| Example | Composition | Molecular Weight[2] | % Migration of Binder[2] | Add-On[3] (Dry Basis) | Solids | pH | Viscosity[2] (cps) |
| 3a | 95 OXEMA/5 MMA[4] | 87,740 | 37% | 32% | 20% | 7.7 | 880 |
| 3b | 85.5 OXEMA/4.5 MMA/ 10 EA | 73,710 | 12% | 21% | 20% | 7.9 | 310 |
| 3c | 85 OXEMA/15 MMA | 105,900 | 45% | 20% | 20% | 7.9 | 16 |
| 3d | 100 OXEMA | 63,820 | 49% | 21% | 20% | 8.0 | 30 |
| 3e | 100 OXEMA | 115,100 | 30% | 21% | 20% | 8.0 | 10 |
| 3f | 100 OXEMA | 115,100 | 42% | 18% | 20% | 7.9 | 39 |
| 3g | 100 OXEMA | 77,070 | 11% | 18% | 20% | 8.0 | 380 |

-continued

| Example | Water-Soluble Polymer Composition | Molecular Weight[2] | % Migration of Binder[2] | Add-On[3] (Dry Basis) | Binder Composition[1] Solids | pH | Viscosity[2] (cps) |
|---|---|---|---|---|---|---|---|
| 3h | No WSP | — | 65% | 21% | 20% | 8.0 | 23 |

[1]3% Water-soluble polymer, 97% polymer latex of Example 1, on a solids basis.
[2]As in Example 2.
[3]Binder solids in saturating paper, percent on total weight.
[4]This binder composition also contains 0.5% hydroxyethyl cellulose (Natrosol 250G, from Hercules, Inc., Wilmington, Delaware) solids on binder solids; MMA is methyl methacrylate.

EXAMPLES 4, 5, AND 6

Other Anionically-Stabilized Polymer Latexes

The binder compositions are made by mixing the appropriate polymer latex with the water-soluble polymer, as indicated in the table below. In each case, the water-soluble polymer is 3% of the binder solids. The pH is adjusted to 8.0 with ammonia, and the binder viscosities are measured both at 40% solids and at 20% solids after aging overnight. Migration resistance is determined on the P-3 saturating paper. The latex of the Example 4 series is an ethyl acrylate/butyl acrylate-based tetrapolymer stabilized by a blend of two anionic surfactants present at a total of about 2% based on polymer solids. The two surfactants are sodium lauryl sulfate and an alkyl polyethoxyethanol sulfate. The anionically-stabilized polymer latex of Examples 5a through 5d is a tetrapolymer based on ethyl acrylate and containing 1% acrylic acid in the copolymer. The surfactant used in this system is 1% on polymer solids of sodium lauryl sulfate. The anionically-stabilized polymer latex used in Examples 6a through 6d is an ethyl acrylate-based terpolymer stabilized by a mixture of about 1% sodium lauryl sulfate and 6% of a nonionic surfactant, both percentages being by weight on polymer solids.

| Example | WSP (3%/latex) (S/S) | % Migration of Binder | Add-On (Dry Basis) | Binder Composition Viscosity 20% Solids | 40% Solids |
|---|---|---|---|---|---|
| 4a | Example 2f | 34% | 19% | 9 cps. | 125 cps. |
| 4b | Example 2g | 10% | 21% | 12 cps. | Gelled |
| 4c | Example 3b | 11% | 21% | — | 780 cps. |
| 4d | None | 63% | 17% | 8 cps. | — |
| 5a | Example 2f | 41% | 17% | 9 cps. | 720 cps. |
| 5b | Example 2g | 20 | 20% | 9 cps. | Gelled |
| 5c | Example 3b | 37% | 19% | 10 cps. | 1200 cps. |
| 5d | None | 67% | 18% | 10 cps. | — |
| 6a | Example 2f | 29% | 19% | 10 cps. | Gelled |
| 6b | Example 2g | 19% | 22% | 17 cps. | Gelled |
| 6c | Example 3b | 26% | 21% | 12 cps. | — |
| 6d | None | 55% | 17% | 9 cps. | |

All of the water-soluble polymer blends with the various polymer latexes showed marked improvement in the migration resistance when compared to the control containing no water-soluble polymer. At the 40% solids level, however, only certain of these systems are preferred, the others having gelled, thus being too high in viscosity for application by the usual methods.

EXAMPLE 7

Migration Resistance of Binder - Blue Dye Test

The latex of Example 2 is diluted, adjusted to pH 7.5 ($NH_4OH$), mixed with WSP to give a 3% WSP binder composition (S/S) and saturated into a heavy needle-punched polyester web at a level of 84% dry add-on. The treated web is dried in an oven at 300° F. for 10 minutes with good air circulation and then tested with the following results:

| Example | WSP | Relative Migration of Blend[1] | Brightness (Treated Web) | Binder Composition Solids | pH | Viscosity (cps.) 1 Hr. | 24 Hr. |
|---|---|---|---|---|---|---|---|
| 7a | Example 2d | 3 | 64 | 25% | 8.0 | 16 | 35 |
| 7b | Example 2e | 3 | 62 | 25% | 7.9 | 16 | 35 |
| 7c | Example 2f | 2 | 51 | 25% | 7.9 | 105 | 58 |
| 7d | Example 2g | 0 | 51 | 25% | 7.9 | 1260 | 1680 |
| 7e | Example 2h | 1 | 62 | 25% | 8.0 | 3200 | 3200 |
| 7f | Example 3b | 0 | 66 | 25% | 8.0 | 1040 | 950 |
| 7g | Example 3c | 2 | 61 | 25% | 8.0 | 55 | 45 |
| 7h | Example 3d | 3 | 53 | 25% | 7.6 | 35 | 16 |
| 7i | Example 3e | 1 | 68 | 25% | 7.9 | 201 | 175 |
| 7j | Example 3f | 2 | 62 | 25% | 7.6 | 80 | 44 |
| 7k | Example 3g | 0 | 63 | 25% | 8.0 | 560 | 780 |
| 7l | None | 4 | 69 | 25% | 7.6 | 16 | 69 |

[1]The needle-punched polyester is saturated and dried in an oven. The resin is stained with a blue dye and a cross section of the web observed to determine the relative migration of the various latices. A wide band of undyed fibers in the center of the web indicates considerable migration.

Migration Ratings: (Visual Observation of Dyed Web)
0 = no migration
1 = very slight
2 = slight
3 = moderate -continued

| Example | WSP | Relative Migration of Blend[1] | Brightness (Treated Web) | Binder Composition Solids | pH | Viscosity (cps.) 1 Hr. | 24 Hr. |
|---|---|---|---|---|---|---|---|
| | | 4 = substantial | | | | | |

Again, it is seen by comparing the results obtained in the Blue Dye Test on binder compositions containing the water-soluble polymer of this invention with the control without the water-soluble polymer that the water-soluble polymer containing systems decrease the migration of the binder, in this case, in a polyester web.

EXAMPLE 8

Thermal Stability of Binder Compositions

The following binder compositions, at 40% total solids and a pH of 8.0 to 8.2, are heated to 100° C. and observed for coagulation. No coagulation is observed in any of these examples.

| Polymer Latex | WSP %[1] | WSP Identity |
|---|---|---|
| Example 2 | 3 | Example 7i |
| Example 2 | 5 | Example 7i |
| Example 2 | 3 | Example 7f |
| Example 2 | 3 | Example 7g |
| Example 2 | 3 | Example 7a |
| Example 2 | 3 | Example 7b |
| Example 2 | 3 | Example 7c |
| Example 4 | 3 | Example 7i |
| Example 4 | 3 | Example 7c |
| Example 4 | 3 | Example 7f |
| Example 5 | 3 | Example 7c |
| Example 5 | 3 | Example 7f |
| Example 2 | 6 | Example 7c |

[1]Percent water-soluble polymer on binder composition solids.

EXAMPLES 9, 10 AND 11

Binder Composition Using Example B and Example C Polymers

The anionically stabilized polymer latex is mixed with 3% of the amine-containing polymers on a solids basis. Binder migration results are given in the following table in which the latices used are:

Example 9 series - an ethylacrylate/butyl acrylate-based tetrapolymer containing a half percent copolymerized acid and further stabilized by 1% sodium dodecylbenzene sulfonate and 0.1% octylphenoxypolyethoxythanol with 40 ethoxy units.

Example 10 series - an ethyl acrylate/butyl acrylate-based pentapolymer containing two percent copolymerized acid and further stabilized by 2.7 percent sodium lauryl sulfate.

Example 11 series - uses the latex of Example 1. The bath solids is 15% except as noted and the paper is P-3 saturating paper in this series of binder migration tests.

| Ex. | Amine-containing Polymer | pH | % Migration |
|---|---|---|---|
| 9a | Example 2f | 7.5 | 9 |
| 9b | Example B | 7.5 | 33 |
| 9c | None | 7.5 | 68 |
| 9d | Example 2f | 8.0 | 16 |
| 9e | Example B | 8.0 | 36 |
| 9f | None | 8.0 | 66 |
| 9g | Example 2f | 8.5 | 24 |
| 9h | Example B | 8.5 | 36 |
| 9i | None | 8.5 | 71 |
| 10a | Example B | 8.5 | 27 |
| 10b | None | 8.5 | 58 |

-continued

| Ex. | Amine-containing Polymer | pH | % Migration |
|---|---|---|---|
| 11a | Example C | 7.1 | 41 |
| 11b | Example C | 8.0 | 44 |
| 11c | None | 8.0 | 65 |
| 11d* | Example B | 8.0 | 47 |
| 11e* | None | 8.0 | 68 |

*The bath solids is 20% in Examples 11d and 11e.

It is clear that the blends with the amine-containing polymers markedly out-perform the controls i.e. the polymer latices used alone. The improvement is evident at the several pH values.

EXAMPLE 12

Vinyl Acetate Copolymer Latex

Resyn X Link 2833 (National Starch and Chemical Corporation, Bridgewater, New Jersey), an anionic latex recommended for use with polyester fibers, is believed to be a vinyl acetate/butylacrylate-based copolymer. Resyn X Link 2833 is blended with 3%, on a solids basis, of the amine-containing polymer of Example 2f to make the binder composition. This binder composition has a pH of 7.9, a Brookfield viscosity (No. 1 spindle, 60 r.p.m.), of 24 cps., and a solids of 30%. Saturating baths are made, at 15% solids and a pH of 6.9, of the binder composition and of the Resyn X Link 2833 alone. Migration measurements show 4% migration for the binder composition with the amine-containing polymer and 48% for the Resyn X Link 2833 when used alone.

The binder composition, at a pH of 7.9, is very stable. When the composition is run continuously between a rubber roll and a steel roll on a Butterworth Padder (H. W. Butterworth and Sons Company, Philadelphia, Pennsylvania) at a load of 60 pounds per linear inch for 30 minutes, no sign of instability is visible.

We claim:

1. A composition adapted to form a bonded composite comprising nonwoven fibers having evenly distributed therewith a binder comprising:

(A) an anionically stabilized polymer latex;

(B) a water-soluble polymer of 20% to 100% by weight of mer units containing an amine group and having a viscosity average molecular weight between 5,000 and 300,000; and (C) a volatile base;

the latex polymer and the water-soluble polymer each being a polymer of at least one ethylenically unsaturated monomer.

2. The binder of claim 1 in which the solids content is 10% to 60% by weight, the viscosity is below 3,000 centipoise, the pH is above 5, component (B) is between 0.1% and 20% by weight of the solids of (A) plus (B), and (A) is at least 50% by weight of the binder on a solids basis.

3. A binder according to claim 2 in which the latex polymer is a polymer or copolymer of a monomer selected from the group styrene, butadiene, vinyl acetate, vinyl chloride, vinylidene chloride, acrylonitrile, chloroprene, esters of acrylic acid and esters of methacrylic acid.

4. A binder according to claim 3 in which the latex polymer is a polymer or copolymer of a monomer selected from the group esters of acrylic acid and esters of methacrylic acid.

5. A binder according to claim 1 in which the water-soluble polymer is a copolymer of cationic and, optionally, nonionic vinyl monomers.

6. A composition according to claim 1 in which the water-soluble polymer is a polymer of a monomer of the formula

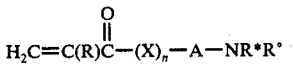

wherein

R is H or $CH_3$;

$n$ is 0 or 1;

X is O or N(H);

A, when $n$ is zero, is $O(CH_2)_x$ wherein x is 2 to 3, or $(O\text{-alkylene})_y$ wherein $(O\text{-alkylene})_y$ is a poly(oxyalkylene) group, having a molecular weight in the range from 88 to 348, in which the individual alkylene radicals are the same or different and are either ethylene or propylene; and A, when $n$ is 1, is an alkylene group having two to 4 carbon atoms;

R* is H, methyl, or ethyl; and $R^o$ is H, phenyl, benzyl, methylbenzyl, cyclohexyl or $(C_1\text{-}C_6)$ alkyl.

7. A composition according to claim 1 in which the water-soluble polymer is a polymer of a monomer of the formula

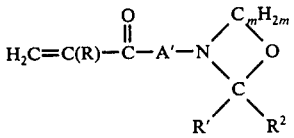

wherein

R is H or $CH_3$;

$m$ is an integer having a value of 2 to 3;

R′, when not directly joined to $R^2$, is selected from the group consisting of hydrogen, phenyl, benzyl, and $(C_1\text{-}C_{12})$ alkyl groups;

$R^2$, when not directly joined to R′, is selected from the group consisting of hydrogen and $(C_1\text{-}C_4)$ alkyl groups;

R′ and $R^2$, when directly joined together, form a 5- to 6- carbon ring with the attached carbon atom of the ring in the formula; and A′ is $O(C_mH_{2m})$ or $(O\text{-alkylene})_n$ in which $(O\text{-alkylene})_n$ is a poly(oxyalkylene) group, having a molecular weight in the range from 88 to 348, in which the individual alkylene radicals are the same or different and are either ethylene or propylene.

8. A binder according to claim 1 in which the water-soluble polymer is a polymer of at least 20% by weight of oxazolidinylethyl methacrylate.

9. A binder according to claim 8 in which the water-soluble polymer is a polymer of 40% to 100% by weight of oxazolidinylethyl methacrylate, has a viscosity average molecular weight between 40,000 and 100,000 and is 1% to 8% by weight of the solids of A) plus B), the composition having a pH between 7 and 8.5.

10. A composition adapted to form a bonded composite comprising nonwoven fibers having evenly distributed therewith a binder comprising:

(A) an anionically stabilized polymer latex;

(B′) a water-insoluble polymer of 20% to 100% by weight of mer units containing an amine group and having a viscosity average molecular weight between 5,000 and 100,000; and (C) a volatile base;

the latex polymer and the water-insoluble polymer each being a polymer of at least one ethylenically unsaturated monomer.

11. The binder of claim 10 in which the solids content is 10% to 60% by weight, the viscosity is below 3,000 centipoise, the pH is above 5 and component B′) is between 0.1% and 20% by weight of the solids of A) plus B′), and A) is at least 50% by weight of the binder on a solids basis.

12. A binder according to claim 11 in which the latex polymer is a polymer or copolymer of a monomer selected from the group styrene, butadiene, vinyl acetate, vinyl chloride, vinylidene chloride, acrylonitrile, chloroprene, esters of acrylic acid and esters of methacrylic acid.

13. A binder according to claim 12 in which the latex polymer is a polymer or copolymer of a monomer selected from the group esters of acrylic acid and esters of methacrylic acid.

14. A binder according to claim 10 in which the water-insoluble polymer of (B′) is a copolymer of cationic and optionally nonionic vinyl monomers.

15. A composition according to claim 10 in which the water-insoluble polymer of B′) is a polymer of a monomer of the formula

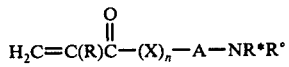

wherein

R is H or $CH_3$;

$n$ is 0 or 1;

$X$ is 0 or N(H);

A, when $n$ is zero, is $O(CH_2)_x$ wherein $x$ is 2 to 3, or $(O\text{-alkylene})_y$ wherein $(O\text{-alkylene})_y$ is a poly(oxyalkylene) group, having a molecular weight in the range from 88 to 348, in which the individual alkylene radicals are the same or different and are either ethylene or propylene; and A, when $n$ is 1, is an alkylene group having two to 4 carbon atoms;

R* is H, methyl, or ethyl; and

R° is H, phenyl, benzyl, methylbenzyl, cyclohexyl, or $(C_1\text{-}C_6)$ alkyl.

16. A composition according to claim 10 in which the water-insoluble polymer of B′) is a polymer of a monomer of the formula

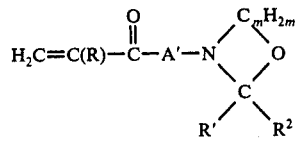

wherein

R is H or $CH_3$;

$m$ is an integer having a value of 2 to 3;

R', when not directly joined to $R^2$, is selected from the group consisting of hydrogen, phenyl, benzyl, and ($C_1$–$C_{12}$) alkyl groups;

$R^2$, when not directly joined to R', is selected from the group consisting of hydrogen and ($C_1$–$C_4$) alkyl groups;

R' and $R^2$, when directly joined together, form a 5- to 6-carbon ring with the attached carbon atom of the ring in the formula; and A' is $O(C_mH_{2m})$ or $(O\text{-alkylene})_n$ in which $(O\text{-alkylene})_n$ is a poly(oxyalkylene) group, having a molecular weight in the range from 88 to 348, in which the individual alkylene radicals are the same or different and are either ethylene or propylene.

17. A binder according to claim 10 in which the water-insoluble polymer of B') is a polymer of at least 20% by weight of oxazolidinylethyl methacrylate.

18. A binder according to claim 17 in which the water-insoluble polymer of B') is a polymer of 30% to 70% by weight of oxazolidinylethyl methacrylate, has a viscosity average molecular weight between 15,000 and 90,000 and is 1% to 8% by weight of the solids of A) plus B'), the composition having a pH between 7 and 8.5.

19. A nonwoven composite, comprising fibers, said composite produced by drying the composition of claim 1.

20. The composite of claim 19 in which the fibers are predominantly fibers selected from the group consisting of cellulosic fibers, polyamide fibers, glass fibers, vinyl resin fibers and polyester fibers.

21. A nonwoven composite, comprising fibers, said composite produced by drying the composition of claim 10.

22. The composite of claim 21 in which the fibers are predominantly fibers selected from the group consisting of cellulosic fibers, polyamide fibers, glass fibers, vinyl resin fibers and polyester fibers.

23. A process of making a nonwoven composite which comprises associating, within a web or mat, fibers selected from the group consisting of cellulosic fibers, polyamide fibers, glass fibers, vinyl resin fibers and polyester fibers and bringing into contact with the fibers the binder of claim 1.

24. A process of making a nonwoven composite which comprises associating, within a web or mat, fibers selected from the group consisting of cellulosic fibers, polyamide fibers, glass fibers, vinyl resin fibers and polyester fibers and bringing into contact with the fibers the binder of claim 10.

* * * * *

UNITED STATES PATENT AND TRADEMARK OFFICE

CERTIFICATE OF CORRECTION

PATENT NO. : 4,119,600

DATED : October 10, 1978

INVENTOR(S) : Ronald D. Bakulu, Robert A Gill, K. Wempe

It is certified that error appears in the above-identified patent and that said Letters Patent are hereby corrected as shown below:

Column 3, ln. 22 _ word "biner" should read -- binder --

Column 3, ln. 5 - phrase "in situ" should be underlined

Column 5, ln. 35 - delete word "two" and in lieu thereof add figure -- 2 --.

Column 6, ln. 36 - close parenthese after word "methacryloxethyl"

Column 6, ln. 42 - Add hypen (-) after "methylene"

Column 7, ln. 52- insert word -- of -- between words"aggregates" and "individual"

Column 10, ln. 62 - delete word "movement" and in lieu thereof, add word -- nonwoven --

Column 17, end of line 47 and beginning of line 48 _ Delete word "octylphenoxypolye-thoxythanol" and in lieu thereof add -- octylphenoxypolyethoxyethanol --

Signed and Sealed this

Seventh Day of August 1979

[SEAL]

Attest:

Attesting Officer

LUTRELLE F. PARKER

Acting Commissioner of Patents and Trademarks